US006260959B1

(12) United States Patent
Takahashi

(10) Patent No.: US 6,260,959 B1
(45) Date of Patent: Jul. 17, 2001

(54) INK EJECTOR

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/313,993

(22) Filed: May 19, 1999

(30) Foreign Application Priority Data

May 20, 1998 (JP) ..... 10-138884
May 20, 1998 (JP) ..... 10-138885

(51) Int. Cl.[7] ..... B41J 2/045; B41J 29/38
(52) U.S. Cl. ..... 347/68; 347/10; 347/11
(58) Field of Search ..... 247/68, 9, 10, 247/11, 57; 358/1.8

(56) References Cited

U.S. PATENT DOCUMENTS 4,879,568 11/1989 Bartky et al. ..... 347/69
4,887,100 12/1989 Michaelis et al. ..... 347/69
4,992,808 2/1991 Bartky et al. ..... 347/69
5,003,679 4/1991 Bartky et al. ..... 29/25.35
5,028,936 7/1991 Bartky et al. ..... 347/69
6,099,103 * 8/2000 Takahashi ..... 347/11
6,109,716 * 8/2000 Takahashi ..... 347/11
6,141,113 * 10/2000 Takahashi ..... 358/1.9

FOREIGN PATENT DOCUMENTS 63-247051 10/1988 (JP) .

* cited by examiner

*Primary Examiner*—Thinh Nguyen
(74) *Attorney, Agent, or Firm*—Oliff & Berridge, PLC

(57) ABSTRACT

An ink ejector includes an ink jet head. The head has ink channels each defined between a pair of actuator walls. The head also has nozzles each communicating with one of the channels. The ejector can eject ink from each of the channels through the associated nozzle by driving the associated walls to increase the volume of the channel once and decrease it subsequently. The walls can be driven by a first ejection pulse and a second ejection pulse of voltage applied to them. The first pulse precedes the second. The first pulse has a width between 0.5T and 1.5T where T is the one-way propagation time during which a pressure wave is propagated one way in the channel. The interval between the first and second pulses is at least 0.3T. The second pulse has a width which is at least 0.3T. The sum of the interval and the width of the second pulse ranges between 1.3T and 1.7T. These settings make it possible to form a clear image on a recording medium without spattering ink or ejecting ink in a wrong direction even at a high temperature.

20 Claims, 11 Drawing Sheets

Fig. 7

| Wb/I1(T) | 0.3 | 0.4 | 0.5 | 0.6 | 0.7 | 0.8 | 0.9 | 1.0 | 1.1 | 1.2 | 1.3 | 1.4 | 1.5 |
|---|---|---|---|---|---|---|---|---|---|---|---|---|---|
| 0.3 | × | × | × | × | × | × | × | ○ | ○ | ○ | ○ | ○ | × |
| 0.4 | × | × | × | × | × | × | ○ | ○ | ○ | ○ | ○ | × | × |
| 0.5 | × | × | × | × | × | ○ | ○ | ○ | ○ | ○ | × | × | × |
| 0.6 | × | × | × | × | ○ | ○ | ○ | ○ | ○ | × | × | × | × |
| 0.7 | × | × | × | ○ | ○ | ○ | ○ | ○ | × | × | × | × | × |
| 0.8 | × | × | ○ | ○ | ○ | ○ | ○ | × | × | × | × | × | × |
| 0.9 | × | ○ | ○ | ○ | ○ | ○ | × | × | × | × | × | × | × |
| 1.0 | ○ | ○ | ○ | ○ | ○ | × | × | × | × | × | × | × | × |
| 1.1 | ○ | ○ | ○ | ○ | × | × | × | × | × | × | × | × | × |
| 1.2 | ○ | ○ | ○ | × | × | × | × | × | × | × | × | × | × |
| 1.3 | ○ | ○ | × | × | × | × | × | × | × | × | × | × | × |
| 1.4 | ○ | × | × | × | × | × | × | × | × | × | × | × | × |
| 1.5 | × | × | × | × | × | × | × | × | × | × | × | × | × |
| 1.6 | × | × | × | × | × | × | × | × | × | × | × | × | × |
| 1.7 | × | × | × | × | × | × | × | × | × | × | × | × | × |

Fig. 8

| Wb/ I1(T) | 2.3 | 2.4 | 2.5 | 2.6 | 2.7 | 2.8 | 2.9 | 3.0 | 3.1 | 3.2 | 3.3 | 3.4 | 3.5 | 3.6 | 3.7 |
|---|---|---|---|---|---|---|---|---|---|---|---|---|---|---|---|
| 0.3 | × | × | × | × | × | × | × | × | × | × | × | × | × | × | × |
| 0.4 | × | ○ | ○ | ○ | ○ | ○ | ○ | ○ | ○ | ○ | ○ | ○ | ○ | ○ | × |
| 0.5 | × | ○ | ○ | ○ | ○ | ○ | ○ | ○ | ○ | ○ | ○ | ○ | ○ | ○ | × |
| 0.6 | × | ○ | ○ | ○ | ○ | ○ | ○ | ○ | ○ | ○ | ○ | ○ | ○ | ○ | × |
| 0.7 | × | ○ | ○ | ○ | ○ | ○ | ○ | ○ | ○ | ○ | ○ | ○ | ○ | ○ | × |
| 0.8 | × | ○ | ○ | ○ | ○ | ○ | ○ | ○ | ○ | ○ | ○ | ○ | ○ | ○ | × |
| 0.9 | × | ○ | ○ | ○ | ○ | ○ | ○ | ○ | ○ | ○ | ○ | ○ | ○ | ○ | × |
| 1.0 | × | ○ | ○ | ○ | ○ | ○ | ○ | ○ | ○ | ○ | ○ | ○ | ○ | ○ | × |
| 1.1 | × | ○ | ○ | ○ | ○ | ○ | ○ | ○ | ○ | ○ | ○ | ○ | ○ | ○ | × |
| 1.2 | × | ○ | ○ | ○ | ○ | ○ | ○ | ○ | ○ | ○ | ○ | ○ | ○ | ○ | × |
| 1.3 | × | ○ | ○ | ○ | ○ | ○ | ○ | ○ | ○ | ○ | ○ | ○ | ○ | ○ | × |
| 1.4 | × | ○ | ○ | ○ | ○ | ○ | ○ | ○ | ○ | ○ | ○ | ○ | ○ | ○ | × |
| 1.5 | × | ○ | ○ | ○ | ○ | ○ | ○ | ○ | ○ | ○ | ○ | ○ | ○ | ○ | × |
| 1.6 | × | ○ | ○ | ○ | ○ | ○ | ○ | ○ | ○ | ○ | ○ | ○ | ○ | ○ | × |
| 1.7 | × | × | × | × | × | × | × | × | × | × | × | × | × | × | × |

Fig. 9

| Wb/ I1(T) | 3.8 | 3.9 | 4.0 | 4.1 | 4.2 | 4.3 | 4.4 | 4.5 | 4.6 | 4.7 | 4.8 | 4.9 | 5.0 | 5.1 | 5.2 |
|---|---|---|---|---|---|---|---|---|---|---|---|---|---|---|---|
| 0.3 | × | × | × | × | × | × | × | × | × | × | × | × | × | × | × |
| 0.4 | × | × | × | × | × | × | ○ | ○ | ○ | ○ | ○ | ○ | ○ | ○ | ○ |
| 0.5 | × | × | × | × | × | × | ○ | ○ | ○ | ○ | ○ | ○ | ○ | ○ | ○ |
| 0.6 | × | × | × | × | × | × | ○ | ○ | ○ | ○ | ○ | ○ | ○ | ○ | ○ |
| 0.7 | × | × | × | × | × | × | ○ | ○ | ○ | ○ | ○ | ○ | ○ | ○ | ○ |
| 0.8 | × | × | × | × | × | × | ○ | ○ | ○ | ○ | ○ | ○ | ○ | ○ | ○ |
| 0.9 | × | × | × | × | × | × | ○ | ○ | ○ | ○ | ○ | ○ | ○ | ○ | ○ |
| 1.0 | × | × | × | × | × | × | ○ | ○ | ○ | ○ | ○ | ○ | ○ | ○ | ○ |
| 1.1 | × | × | × | × | × | × | ○ | ○ | ○ | ○ | ○ | ○ | ○ | ○ | ○ |
| 1.2 | × | × | × | × | × | × | ○ | ○ | ○ | ○ | ○ | ○ | ○ | ○ | ○ |
| 1.3 | × | × | × | × | × | × | ○ | ○ | ○ | ○ | ○ | ○ | ○ | ○ | ○ |
| 1.4 | × | × | × | × | × | × | ○ | ○ | ○ | ○ | ○ | ○ | ○ | ○ | ○ |
| 1.5 | × | × | × | × | × | × | ○ | ○ | ○ | ○ | ○ | ○ | ○ | ○ | ○ |
| 1.6 | × | × | × | × | × | × | ○ | ○ | ○ | ○ | ○ | ○ | ○ | ○ | ○ |
| 1.7 | × | × | × | × | × | × | × | × | × | × | × | × | × | × | × |

Fig. 10

| Wb/ I1(T) | 5.3 | 5.4 | 5.5 | 5.6 | 5.7 | 5.8 | 5.9 | 6.0 | 6.1 | 6.2 | 6.3 | 6.4 | 6.5 | 6.6 | 6.7 |
|---|---|---|---|---|---|---|---|---|---|---|---|---|---|---|---|
| 0.3 | × | × | × | × | × | × | × | × | × | × | × | × | × | × | × |
| 0.4 | ○ | ○ | ○ | ○ | × | × | × | × | × | × | × | ○ | ○ | ○ | ○ |
| 0.5 | ○ | ○ | ○ | ○ | × | × | × | × | × | × | × | ○ | ○ | ○ | ○ |
| 0.6 | ○ | ○ | ○ | ○ | × | × | × | × | × | × | × | ○ | ○ | ○ | ○ |
| 0.7 | ○ | ○ | ○ | ○ | × | × | × | × | × | × | × | ○ | ○ | ○ | ○ |
| 0.8 | ○ | ○ | ○ | ○ | × | × | × | × | × | × | × | ○ | ○ | ○ | ○ |
| 0.9 | ○ | ○ | ○ | ○ | × | × | × | × | × | × | × | ○ | ○ | ○ | ○ |
| 1.0 | ○ | ○ | ○ | ○ | × | × | × | × | × | × | × | ○ | ○ | ○ | ○ |
| 1.1 | ○ | ○ | ○ | ○ | × | × | × | × | × | × | × | ○ | ○ | ○ | ○ |
| 1.2 | ○ | ○ | ○ | ○ | × | × | × | × | × | × | × | ○ | ○ | ○ | ○ |
| 1.3 | ○ | ○ | ○ | ○ | × | × | × | × | × | × | × | ○ | ○ | ○ | ○ |
| 1.4 | ○ | ○ | ○ | ○ | × | × | × | × | × | × | × | ○ | ○ | ○ | ○ |
| 1.5 | ○ | ○ | ○ | ○ | × | × | × | × | × | × | × | ○ | ○ | ○ | ○ |
| 1.6 | ○ | ○ | ○ | ○ | × | × | × | × | × | × | × | ○ | ○ | ○ | ○ |
| 1.7 | × | × | × | × | × | × | × | × | × | × | × | × | × | × | × |

Fig. 11

| Wb/ I1(T) | 6.8 | 6.9 | 7.0 | 7.1 | 7.2 | 7.3 | 7.4 | 7.5 | 7.6 | 7.7 | 7.8 | 7.9 | 8.0 | 8.1 | 8.2 |
|---|---|---|---|---|---|---|---|---|---|---|---|---|---|---|---|
| 0.3 | × | × | × | × | × | × | × | × | × | × | × | × | × | × | × |
| 0.4 | ○ | ○ | ○ | ○ | ○ | ○ | ○ | ○ | ○ | × | × | × | × | × | × |
| 0.5 | ○ | ○ | ○ | ○ | ○ | ○ | ○ | ○ | ○ | × | × | × | × | × | × |
| 0.6 | ○ | ○ | ○ | ○ | ○ | ○ | ○ | ○ | ○ | × | × | × | × | × | × |
| 0.7 | ○ | ○ | ○ | ○ | ○ | ○ | ○ | ○ | ○ | × | × | × | × | × | × |
| 0.8 | ○ | ○ | ○ | ○ | ○ | ○ | ○ | ○ | ○ | × | × | × | × | × | × |
| 0.9 | ○ | ○ | ○ | ○ | ○ | ○ | ○ | ○ | ○ | × | × | × | × | × | × |
| 1.0 | ○ | ○ | ○ | ○ | ○ | ○ | ○ | ○ | ○ | × | × | × | × | × | × |
| 1.1 | ○ | ○ | ○ | ○ | ○ | ○ | ○ | ○ | ○ | × | × | × | × | × | × |
| 1.2 | ○ | ○ | ○ | ○ | ○ | ○ | ○ | ○ | ○ | × | × | × | × | × | × |
| 1.3 | ○ | ○ | ○ | ○ | ○ | ○ | ○ | ○ | ○ | × | × | × | × | × | × |
| 1.4 | ○ | ○ | ○ | ○ | ○ | ○ | ○ | ○ | ○ | × | × | × | × | × | × |
| 1.5 | ○ | ○ | ○ | ○ | ○ | ○ | ○ | ○ | ○ | × | × | × | × | × | × |
| 1.6 | ○ | ○ | ○ | ○ | ○ | ○ | ○ | ○ | ○ | × | × | × | × | × | × |
| 1.7 | × | × | × | × | × | × | × | × | × | × | × | × | × | × | × |

INK EJECTOR

BACKGROUND OF THE INVENTION

1. Field of the Invention

The present invention relates to an ink ejector for forming an image on a recording medium such as recording paper by ejecting ink from a number of channels in accordance with print instructions.

2. Description of Related Art

Of all non-impact printers, ink jet printers have simple principles and are easy of multiple gradation and colorization. Drop-on-demand ink jet printers eject only droplets of ink for printing. Ink jet printers of this type are coming rapidly into wide use because of high ejection efficiency and low running costs.

For example, U.S. Pat. Nos. 4,879,568, 4,887,100, 4,992,808, 5,003,679, and 5,028,936, corresponding to Japanese Patent Application Laid-Open No. 63-247051, disclose an ink ejector of the shear mode type for use in a drop-on-demand printer, respectively. Piezoelectric material is used in the disclosed apparatus. The ejector ejects a series of ink droplets through one of nozzles to form a thick and clear image on a recording medium in accordance with the print instruction for one dot.

The viscosity of ink varies with temperature. As the temperature of ink rises, the ink viscosity lowers naturally. This causes ink droplets to be ejected in different manners by the ejector at a predetermined normal temperature (approx. 25 centigrade) and at a higher temperature (approx. 30–45 centigrade). At a higher temperature, ink may be ejected at such a pressure as can cause no ink ejection at a normal temperature, or ink may be spattered or splashed in fine particles. Some of the ink particles may stick to a nozzle plate which defines the nozzle. The surface tension of the ink sticking to the nozzle plate may cause the succeeding ink droplets to be ejected in wrong directions.

The ink temperature may be raised by higher ambient temperature, the heat generated from a controller of the ejector, the heat generated from deformation of the piezoelectric material when ink is ejected, and the heat generated from the carriage motor for moving the ejector relative to a recording paper.

If ink droplets are spattered or ejected in wrong directions, as stated above, excess ink droplets are ejected or ink droplets are ejected onto wrong spots, resulting in poor printing quality.

It has therefore been demanded to provide an ink ejector which can form a clear or sharp image not only at a normal temperature but also at a higher temperature.

SUMMARY OF THE INVENTION

It is an object of the invention to provide an ink ejector for ejecting two or more ink droplets in accordance with the print instruction for one dot and forming a clear or sharp image even at a higher temperature.

In accordance with a first aspect of the invention, an ink ejector is provided which includes and ink jet head for ejecting ink and a controller.

The ink jet head has an ink channel formed therein, which can be filled with ink. The head also has an ink nozzle formed therein and communicating with the channel. The head includes an actuator provided therein for changing the volume of the channel.

The controller controls the actuator to change the channel volume to eject a series of ink droplets from the channel through the nozzle in accordance with the print instruction for one dot. In accordance with the print instruction for one dot, the controller outputs ejection pulses of voltage for driving the actuator to the actuator. The pulses include at least a first pulse and a second pulse which follows the first pulse.

The first pulse has a width between 0.5T and 1.5T where T is the one-way propagation (delay) time during which a pressure wave is propagated one way in the channel. The interval between the first and second pulses, which corresponds to an interval between a falling point (trailing edge) of the first pulse and a rising point (leading edge) of the second pulse, is at least 0.3T. The second pulse has a width which is at least 0.3T. The sum of the pulse interval and the width of the second pulse ranges between 1.3T and 1.7T.

The ejection of the droplets involves increasing the volume of the channel once and decreasing it subsequently. When the volume increases, the pressure in the channel lowers once so that ink flows into it. Subsequently, when the volume decreases, a high pressure develops in the channel to eject an ink droplet. As stated above, the controller outputs at least a first ejection pulse and a second ejection pulse to the actuator in accordance with the print instruction for one dot. This causes the ink jet head to eject at least two consecutive ink droplets in accordance with the print instruction for one dot.

As stated above in connection with the related art, however, the viscosity of ink lowers as the ink temperature rises. Consequently, the ink droplets may be spattered or ejected in wrong directions. As a result of the inventor's studies with the ejector, he discovered that, by setting the widths of the first and second pulses and the interval between the two pulses as stated above, it was possible to form a clear image on a recording medium without spattering ink or ejecting ink in a wrong direction. Specifically, the width of the first pulse should range between 0.5T and 1.5T, and the sum of the width of the second pulse and the pulse interval should range between 1.3T and 1.7T. In addition, the width of the second pulse and the interval should each be 0.3T or longer. As a result, the ejector can form a clear image not only at a predetermined normal temperature but also at a higher temperature.

After the controller outputs the ejection pulses to the actuator, it may output to the actuator a non-ejection pulse of voltage for changing the channel volume to cancel the pressure wave vibration in the channel.

In this case, after the ink droplets are ejected in accordance with the print instruction for one dot, the controller applies the non-ejection pulse to develop pressure in the channel. The pressure changes the channel volume to cancel the pressure wave vibration generated in the channel by the ejection of the droplets. This prevents accidental drops of ink from exiting the nozzle through the channel, and makes it possible to immediately set up for the next ink ejection cycle according to the next print instruction. It is therefore possible to improve the print speed.

The term "vibration cancellation" means not only damping the pressure wave vibration completely, but damping it to such a degree that no ink can be ejected.

The time between the trailing edge of the last ejection pulse and the middle point of the non-ejection pulse may range between 2.25T and 2.75T. Thenon-ejection pulse may have a width between 0.3T and 0.8T. The inventor discovered that it was possible to prevent accidental drops more reliably by limiting the time and the pulse width as stated above. As a result, it is possible to form a clearer image at a higher temperature.

The channel may be defined between side walls made of piezoelectric material. The walls are the actuator. The voltage application to the piezoelectric material deforms it to change the volume of the channel. The actuator of piezoelectric material is simple in structure, durable and cheap. This makes the ejector simple in structure and sufficiently durable, and can make production costs low.

In accordance with a second aspect of the invention, another ink ejector is provided which includes an ink jet head for ejecting ink and a controller.

This ink jet head has an ink channel formed therein, which can be filled with ink. The head also has an ink nozzle formed therein and communicating with the channel. The head includes an actuator provided therein for changing the volume of the channel.

This controller controls the actuator to change the channel volume to eject a series of ink droplets from the channel through the nozzle in accordance with the print instruction for one dot. In accordance with the print instruction for one dot, the controller outputs ejection pulses of voltage to the actuator. The pulses include at least a first pulse and a second pulse which follows the first pulse.

The width of the first pulse is either the one-way propagation time T during which a pressure wave is propagated one way in the channel, or N·T where N is 3 or a larger odd number. The interval between the first and second pulses is N·T±0.6T. The width of the second pulse ranges between 0.4T and 1.6T.

The ejection of the droplets involves increasing the volume of the channel once and decreasing it subsequently. When the volume increases, the pressure in the channel lowers once so that ink flows into it. Subsequently, when the volume decreases, a high pressure develops in the channel to eject an ink droplet.

As stated above, the controller outputs at least a first ejection pulse and a second ejection pulse to the actuator in accordance with the print instruction for one dot. This causes the ink jet head to eject at least two consecutive ink droplets in accordance with the print instruction for one dot.

As stated above in connection with the related art, however, the viscosity of ink lowers as the ink temperature rises. Consequently, the ink droplets may be spattered or ejected in wrong directions. As a result of the inventor's studies with the ejector, he discovered that, by setting the widths of the first and second pulses and the interval between the two pulses as stated above, it was possible to form a clear image on a recording medium without spattering ink or ejecting ink in a wrong direction. Specifically, the width of the first pulse should be either the one-way propagation time T during which a pressure wave is propagated one way in the channel, or N·T where N is 3 or a larger odd number. The interval between the first and second pulses should be N·T±0.6T where N is 3 or a larger odd number. The width of the second pulse should range between 0.4T and 1.6T. As a result, the ejector can form a clear image not only at a predetermined normal temperature but also at a higher temperature.

After the controller outputs the ejection pulses to the actuator, it may output to the actuator a non-ejection pulse of voltage for changing the channel volume to cancel the pressure wave vibration in the channel.

In this case, after the ink droplets are ejected in accordance with the print instruction for one dot, the controller applies the non-ejection pulse to develop pressure in the channel. The pressure changes the channel volume to cancel the pressure wave vibration generated in the channel by the ejection of the droplets. This prevents accidental drops of ink from exiting the nozzle through channel, and makes it possible to immediately set up for the next ink ejecting cycle according to the next print instruction. It is therefore possible to improve the print speed.

The time between the trailing edge of the last ejection pulse and the middle point of the non-ejection pulse may range between 2.25T and 2.75T. The width of the non-ejection pulse may range between 0.3T and 0.8T or between 1.3T and 1.8T. The inventor discovered that it was possible to prevent accidental drops more reliably by limiting the time and the pulse width as stated above. As a result, it is possible to form a clearer image at a higher temperature.

The channel may be defined between side walls made of piezoelectric material. The walls are the actuator. The voltage application to the piezoelectric material deforms it to change the volume of the channel. The actuator of piezoelectric material is simple in structure, durable and cheap. This makes the ejector simple in structure and sufficiently durable, and can make production costs low.

BRIEF DESCRIPTION OF THE DRAWINGS

A preferred embodiment of the invention is described with reference to the accompanying drawings, in which:

FIG. 7 is a table showing the results of experiments made with the width of the second ejection pulse of the waveform and the interval between the first and second ejection pulses of the waveform varied, and providing the first condition.

FIGS. 8–11 are tables showing the results of experiments made with the width of the second ejection pulse of the waveform and the interval between the first and second ejection pulses of the waveform varied, and providing the second condition.

DETAILED DESCRIPTION OF PREFERRED EMBODIMENTS

Figure 1A:
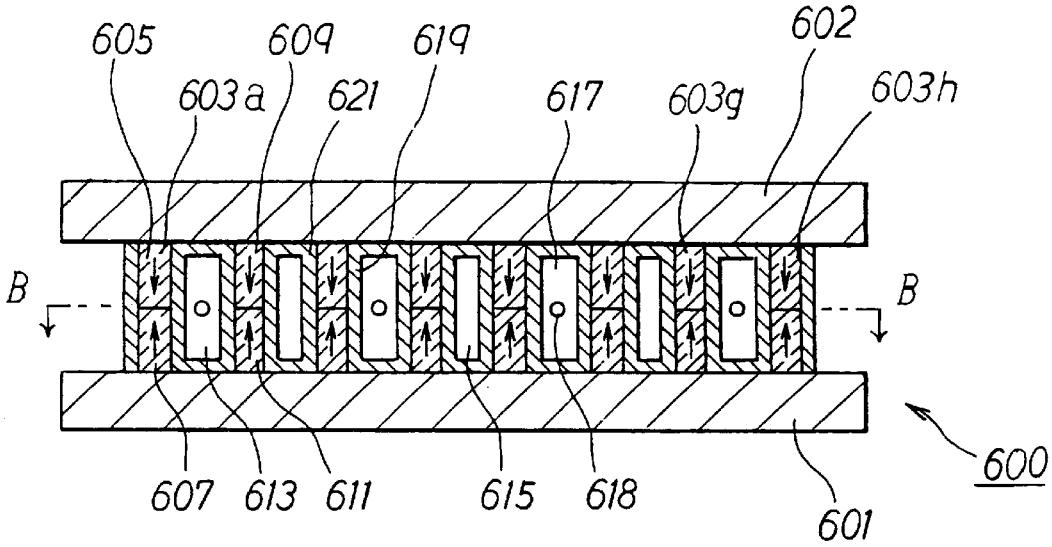
FIG. 1A is a cross section taken on the line A—A of FIG. 1B, showing an ink ejector in accordance with an embodiment of the invention.

An ink ejector embodying the invention will be explained with reference to FIGS. 1A, 1B and 2, which show an embodiment of the ink ejector used for a drop-on-demand type ink jet printer. The ejector 600 includes a base wall 601 and a top wall 602, between which eight shear mode actuator walls 603*a*–603*h* extend. The actuator walls 603*a*–603*h* each consist of an upper part 605 and a lower part 607, which are made of piezoelectric material. The wall parts 605 and 607 are bonded to the top wall 602 and the base wall 601, respectively, and polarized in the opposite directions of arrows 609 and 611, respectively. The actuator walls 603*a*, 603*c*, 603*e* and 603*g* pair with the actuator walls 603*b*, 603*d*, 603*f* and 603*h*, respectively, to define a channel 613 between each pair of actuator walls. The actuator walls 603*b*, 603*d* and 603*f* pair with the actuator walls 603*c*, 603*e* and 603*g*, respectively, to define a space 615 between each pair of actuator walls. The spaces 615 are narrower than the channels 613.

At one end of the channels 613 is secured a nozzle plate 617 formed with nozzles 618 each communicating with one of the channels. The other ends of the channels 613 are connected through a manifold 626 to an ink supply (not shown). The manifold 626 includes a front wall 627 and a rear wall 628. These walls 627 and 628, part of the top wall 602 and part of the base wall 601 define a chamber 629. The front wall 627 is formed with holes each communicating with one of the channels 613. Ink can be supplied from the supply to the chamber 629, and then be distributed to the channels 613.

The longer four sides of each channel 613 are lined with an electrode 619. The longer four sides of each space 615 are lined with an electrode 621. The outer sides of the actuator walls 603*a* and 603*h* at both ends are each lined with an electrode 621. The electrodes 619 and 621 take the form of metallized layers. The electrode 619 in each channel 613 is passivated with an insulating layer (not shown) for insulation from ink. The electrodes 619 in the channels 613 are connected to a controller 625 for applying voltage to these electrodes. The controller 625 is provided in or on the ejector 600. The other electrodes 621 are connected to a common ground return 623.

In operation, the voltage applied to the electrode 619 in each channel 613 causes the associated actuator walls to deform piezoelectrically in such directions that the channel enlarges in volume. If, as shown in FIG. 2, a predetermined voltage of E volts is applied to the electrode 619 between the actuator walls 603*e* and 603*f*, for instance, electric fields are generated in these walls in the opposite directions of arrows 631 and 632. This deforms the walls 603*e* and 603*f* piezoelectrically in such directions that the associated channel 613 enlarges, reducing the pressure in this channel to a negative pressure.

The voltage applied to the electrode 619 is held for a period L/V where L is the channel length and V is the sound velocity (the velocity of the acoustic pressure wave) in the ink in the channel 613. While the voltage is applied, ink is supplied to the channel 613. The period L/V is the one-way propagation time T during which the pressure wave in the channel 613 is propagated one way longitudinally of the channel.

According to the theory of pressure wave propagation, the negative pressure in the channel 613 reverses into a positive pressure when the period L/V passes after the voltage is applied to the electrode 619. When the pressure becomes positive, the voltage is returned to zero volt. This allows the deformed actuator walls 603*e* and 603*f* to return to their original condition (FIGS. 1A and 1B), generating a positive pressure in the channel 613. This pressure is added to the pressure which has reversed to be positive reversed to be positive. As a result, a relatively high pressure develops in that portion of the channel 613 which is near to the associated nozzle 618. This pressure ejects ink from the channel 613 through the nozzle 618.

Figure 1B:
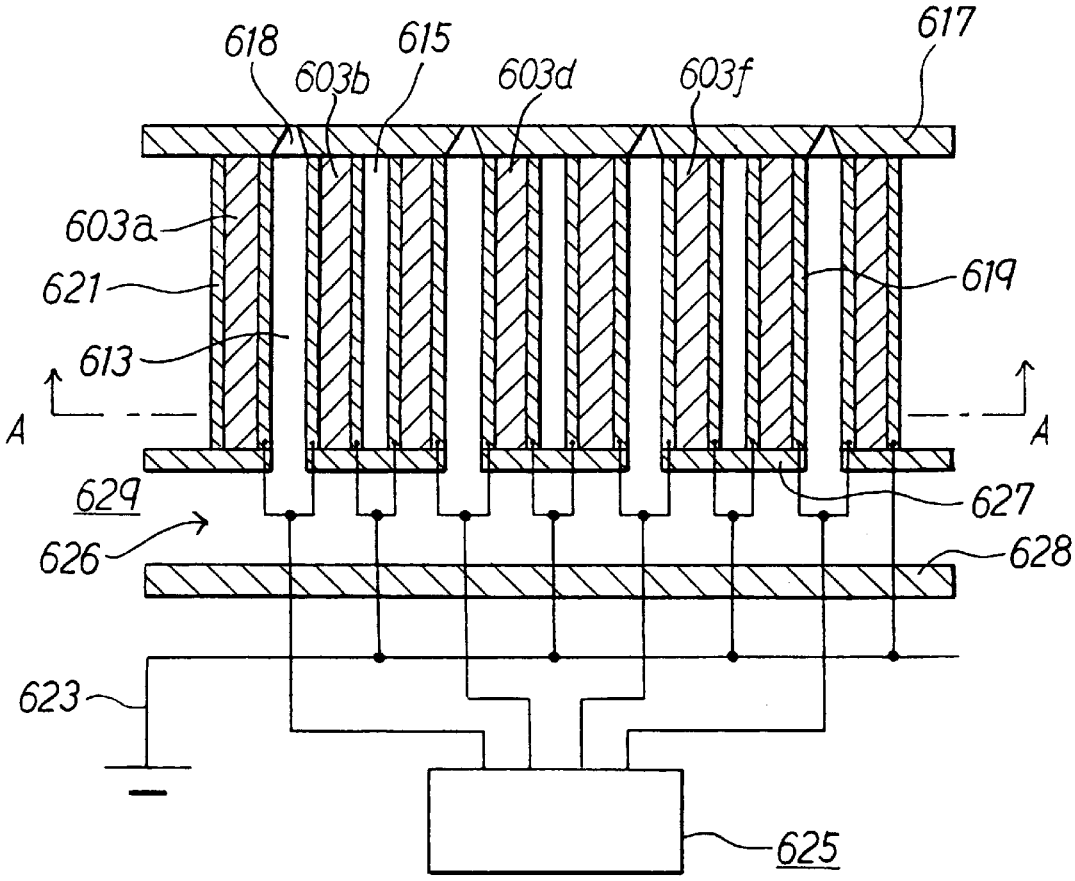
FIG. 1B is a cross section taken on the line B—B of FIG. 1A.
Figure 2:
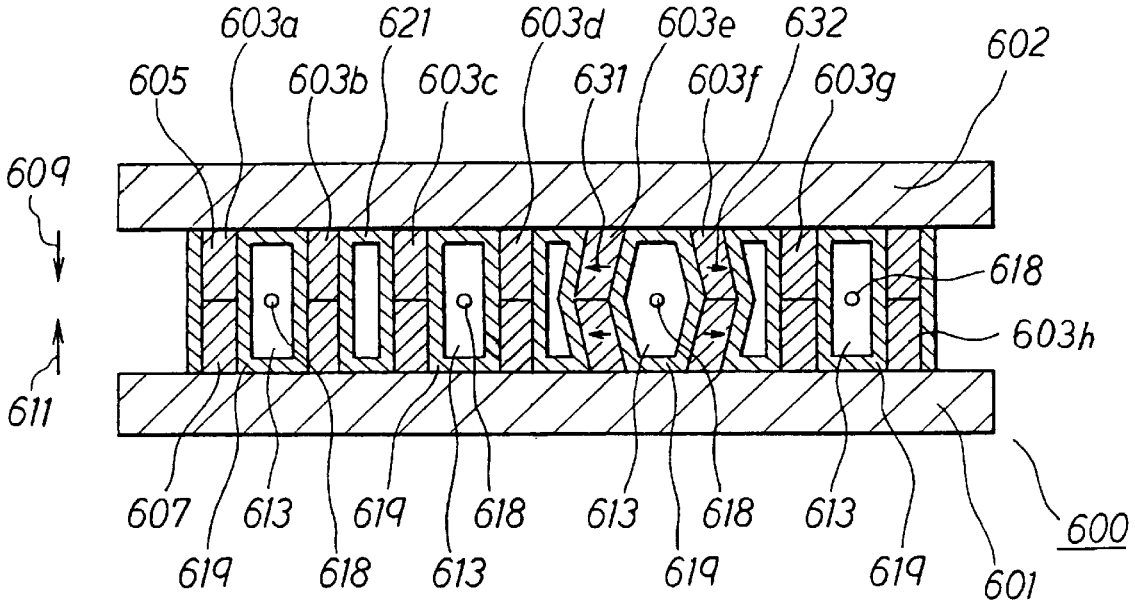
FIG. 2 is a cross section similar to FIG. 1A, showing the operation of the ink ejector.

The ejector 600 is mounted on a carriage (not shown) for moving along a platen (not shown), and has four channels 613 as shown in FIGS. 1A, 1B and 2.

Each channel 613 has a length L of 7.5 millimeters. Each nozzle 618 has a length of 100 microns (micrometers), a diameter of 40 microns at its front end and a diameter of 72 microns at its rear end. The space between the outer side of the nozzle plate 617 and the recording medium on the platen is 1–2 millimeters.

Figure 3:
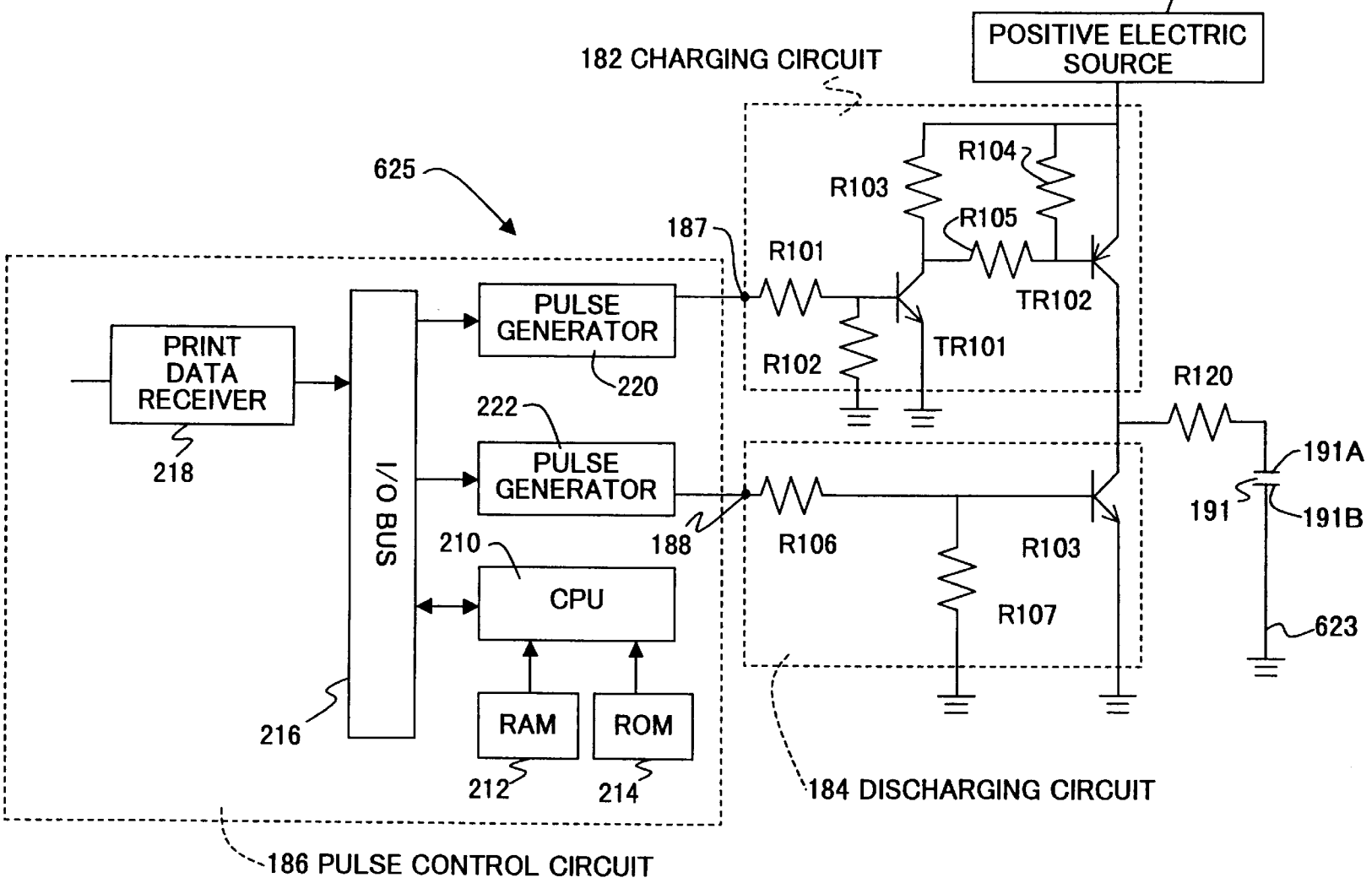
FIG. 3 is a block/circuit diagram of the controller of an ink ejector to which the invention is applied.

With reference to FIG. 3, the ejector 600 includes the controller 625 which includes a pulse control circuit 186, four charging circuits 182 (only one shown) and four discharging circuits 184 (only one shown). Four capacitors 191 (only one shown) represent the piezoelectric materials of the actuator walls 603*a*–603*h* and the electrodes 619 and 621 of this ejector. The capacitors 191 have terminals 191A and 191B, which correspond to the electrodes 619 and 621, respectively. The terminals 191A and 191B are connected to the controller 625 and the ground return 623, respectively.

Each charging circuit 182 has an input terminal 187, through which this circuit can receive from the pulse control circuit 186 a signal for application of a voltage of E volts to one of the capacitor terminals 191A (electrodes 619 in the channels 613). This voltage may be 20 volts. Each discharging circuit 184 has an input terminal 188, through which this circuit can receive from the control circuit 186 a signal for application of no voltage (0 volt) to one of the terminals 191A.

Each charging circuit 182 includes transistors TR101 and TR102. The base of the transistor TR101 is connected to the associated input terminal 187 through a resistor R101 and grounded through a resistor R102. The emitter of the transistor TR101 is grounded directly, and the collector of this transistor is connected to a common positive electric source 189 of E volts through a resistor R103. The base of the transistor TR102 is connected to the source 189 through a resistor R104, and to the collector of the transistor TR101 through a resistor R105. The emitter of the transistor TR102 is connected directly to the source 189, and the collector of this transistor is connected to the associated capacitor terminal 191A through a resistor R120.

If an ON signal (+5 volts) is input to the input terminal 187, the transistor TR101 becomes conductive, allowing current from the positive electric source 189 to flow from the collector of this transistor to the emitter of the transistor. This raises the voltages applied to the resistor R105 and the resistor R104, which is connected to the source 189. Consequently, the current flowing into the base of the transistor TR102 increases, making this transistor conductive between its emitter and collector. As a result, the voltage of E volts is applied from the source 189 through the emitter and the collector of the transistor TR102, and through the resistor R120, to the capacitor terminal 191A.

Each discharging circuit 184 includes a transistor TR103, the base of which is connected to the associated input terminal 188 through a resistor R106 and grounded through a resistor R107. The emitter of the transistor TR103 is grounded directly, and the collector of this transistor is connected to the associated capacitor terminal 191A through the resistor R120 associated with this terminal.

If an ON signal (+5 volts) is input to the input terminal 188, the transistor TR103 becomes conductive, grounding the capacitor terminal 191A through the resistor R120.

Explanation will be made of the variation in the voltage applied to each capacitor 191 (actuator walls) by the associated charging circuit 182 and the associated discharging circuit 184.

Figure 4:
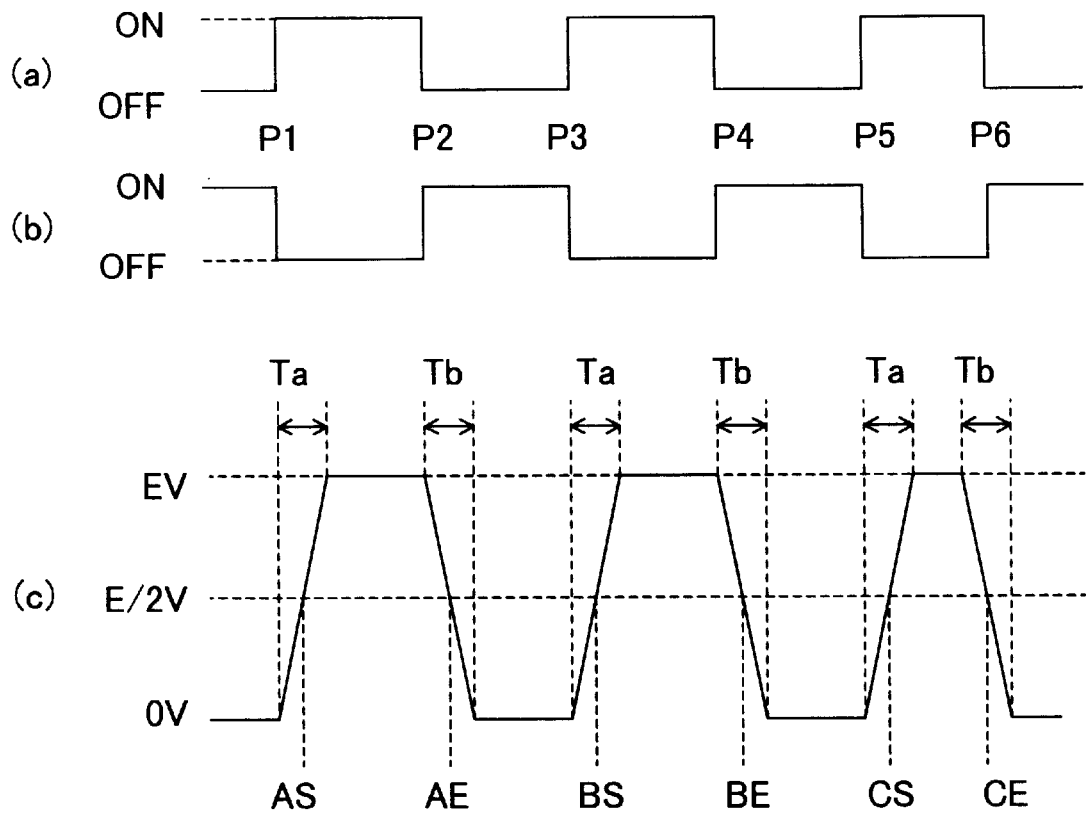
FIG. 4 is timing charts showing the operations of the charging and discharging circuits of this controller.

As shown in (a) of FIG. 4, the signal input to the input terminal 187 of the charging circuit 182 is normally off. For ejection of ink droplets, the input signal becomes on at a point of time P1, off at a point of time P2, on at a point of time P3, off at a point of time P4, on at a point of time P5 and off at a point of time P6. As shown in (b) of FIG. 4, the signal input to the input terminal 188 of the discharging circuit 184 becomes off at the points P1, P3 and P5, and on at the points P2, P4 and P6.

In this case, as shown in (c) of FIG. 4, the voltage applied to the terminal 191A of the capacitor 191 is held normally at 0 volt. This voltage becomes E volts when a charging time Ta passes after the capacitor 191 starts charging at the point P1. The time Ta depends on the transistor TR102, the resistor R120 and the electric capacity of the actuator walls, which are shear mode type piezoelectric elements, corresponding to the capacitor 191. The voltage becomes 0 volt when a discharging time Tb passes after the capacitor 191 starts discharging at the point P2. The time Tb depends on the transistor TR103, the resistor R120 and the actuator wall capacity.

In this way, the drive waveform of voltage applied actually to the capacitor terminal 191A (electrode 619) is delayed by the time Ta and the time Tb when it rises and falls, respectively. Therefore, the points of time when the applied voltage is E/2 volts, which may be 10V, are defined as its approximate rising points AS, BS and CS and its approximate falling points AE, BE and CE. In order to time these rising and falling points suitably as stated later, the pulse control circuit 186 controls the points of time P1–P6 of the signals input to the input terminals 187 and 188.

Back to FIG. 3, the pulse control circuit 186 includes a CPU 210 for various operations, which is connected to a RAM 212 and a ROM 214. The RAM 212 stores print data and other data in it. The ROM 214 stores in it the control program for the control circuit 186 and the sequence data for generation of ON and OFF signals at the points of time P1–P6.

Figure 5:
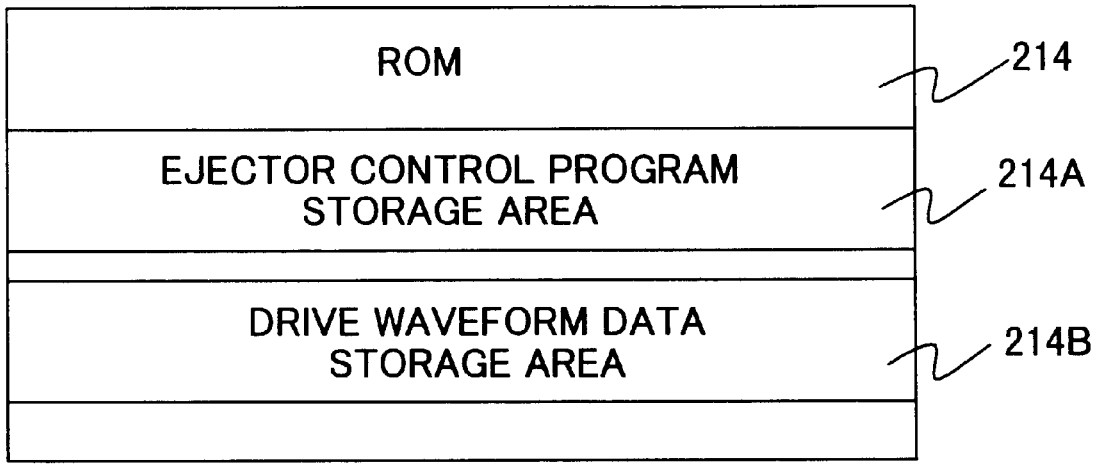
FIG. 5 is an illustration showing the structure of the ROM of this controller.

As shown in FIG. 5, the ROM 214 includes an ejector control program storage area 214A and a drive waveform data storage area 214B. The sequence data relating to the voltage waveform of voltage are stored in the area 214B.

The CPU 210 is connected to an I/O bus 216 via which various data can be input and output. The bus 216 is connected to a print data (print instruction) receiver 218, four first pulse generators 220 (only one shown) and four second pulse generators 222 (only one shown). The output terminal of each first pulse generator 220 is connected to the input terminal 187 of one of the charging circuits 182. The output terminal of each second pulse generator 222 is connected to the input terminal 188 of one of the discharging circuits 184.

In accordance with the sequence data stored in the area 214B of the ROM 214, the CPU 210 controls the pulse generators 220 and 222. Therefore, by storing various patterns of the points P1–P6 in advance in this area 214B, it is possible to apply to the actuator walls 603*a*–603*h* a desired drive waveform of voltage in accordance with the print instructions for one cycle. In accordance with print data, the CPU 210 causes a drive waveform of voltage to be applied to the associated actuator walls to eject ink from the associated channels 613.

Figure 6:
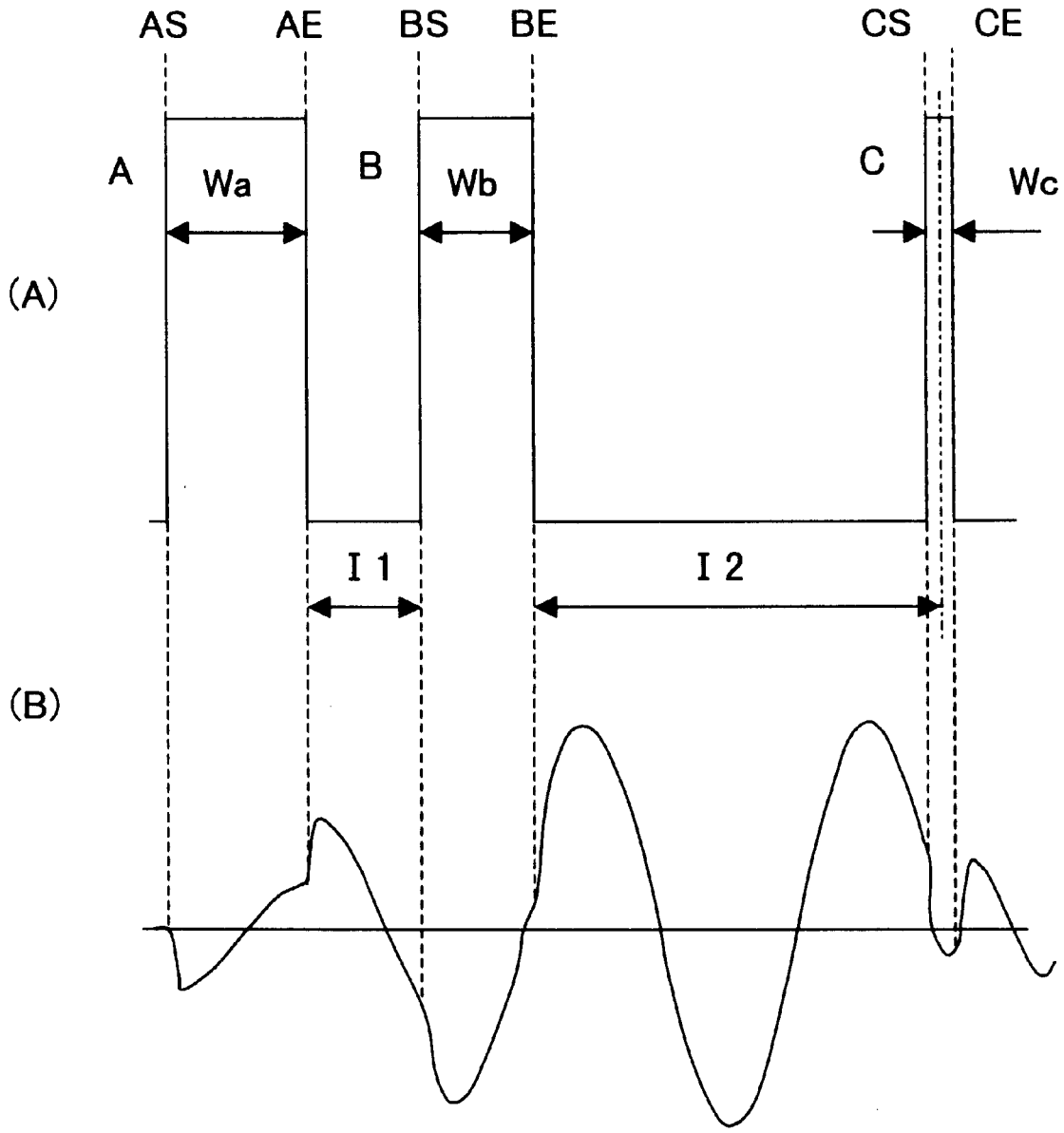
FIG. 6 is an illustration showing an approximate drive waveform in the ejector to which the invention is applied and the pressure wave vibration generated in response to this waveform.

In FIG. 6, (A) shows an approximate drive waveform of voltage in the ejector embodying the invention, and (B) shows the pressure wave vibration generated in accordance with this waveform in each channel 613. As shown in (A) of FIG. 6, the waveform includes two ejection pulses A and B for ejection of two ink droplets and a non-ejection pulse C for cancellation of the pressure wave vibration remaining in each channel 613. The peak (voltage) values of the pulses A–C are E volts.

When the first ejection pulse A rises at a point of time AS, electric fields are generated in the appropriate actuator walls (603*e* and 603*f* in FIG. 2). The fields enlarge the volume of the associated channel 613, reducing the pressure in the channel, which includes the vicinity of the associated nozzle 618. Then, ink flows into the channel 613. In the meantime, the enlargement in volume generates a pressure wave vibration, which develops a pressure. This pressure increases, and converts the pressure in the channel 613 into a positive pressure, which reaches its peak when the one-way propagation time T passes after the point AS. The pulse A falls at a point of time AE near the pressure peak, reducing the volume of the channel 613. The reduced volume develops a pressure, which is added to the pressure converted to be positive. The addition develops a relatively high pressure in that portion of the channel 613 which is near to the nozzle 618. This pressure ejects an ink droplet from the channel 613 through the nozzle 618.

Subsequently, after the positive pressure in the channel 613 converts into a negative pressure, the second ejection pulse B rises at a point of time BS. The pulse interval between the points AE and BS is I1. This pulse B falls at a point of time BE near the point when the one-way propagation time T passes after the rising point BS. This ejects another ink droplet likewise from the channel 613.

While the carriage is moving relative to the recording paper, the two ink droplets are ejected onto slightly displaced or dislocated points on the paper and stick to it.

Thereafter, before the positive pressure in the channel 613 becomes negative, the non-ejection pulse C rises at a point of time CS. After the pressure becomes negative, this pulse C falls at a point of time CE. At the rising point CS, the still positive pressure decreases rapidly. At the falling point CE, the pressure which has become negative increases rapidly. This cancels the pressure wave vibration, and therefore the pulse C causes no ink ejection.

I2 is the time between the falling point BE of the second ejection pulse and the middle point between the rising point CS and the falling point CE of the non-ejection pulse. The pulses A–C have widths Wa, Wb and Wc, respectively.

Thus, the ejector ejects two consecutive ink droplets in accordance with the print instruction for one dot. This makes it possible to form a thick and clear image on a recording medium in comparison with a case where a single ink droplet is ejected for one dot.

Experiments of the inventor have, however, shown that the pressure wave vibration in the channel 613 which is shown in (B) of FIG. 6 does not appear in exact form as ink menisci from the nozzle 618, but the menisci protrude and retract in a slower cycle than the pressure wave vibration, and vibrate complexly in combination with the pressure wave vibration etc. This is conceived to be affected by the surface tension of the ink in the nozzle 618, and greatly by temperature. At a high temperature between about 30 and 45 centigrade, the viscosity of ink is low, and therefore the ink droplets ejected from the nozzle 618 may be spattered or the succeeding droplets may be ejected in wrong directions from the nozzle. This causes excess ink droplets to be ejected or ink droplets to be ejected onto wrong spots, resulting in poor print quality.

The inventor has conceived that, if the pulse interval I1, the time I2 and the pulse widths Wa, Wb and Wc are set suitably, no ink droplet can be spattered or ejected in a wrong direction even when the ink temperature is high. With the values Wa, I1, Wb, I2 and Wc varied, he made further experiments to find values for better printing without ink droplets being spattered or ejected in wrong directions even when the ink temperature is high.

The ink used in these experiments has a viscosity of about 3 mPa·s and a surface tension of 30 mN/m at a temperature of 25 centigrade. The ratio L/V (=T) where L is the length of the channels 613 and V is the sound velocity in the ink in the channels is 8 microseconds. During the experiments, the ink temperature was 40 centigrade and the ink viscosity was 2 mPa·s.

As a result of these experiments, good printing was achieved under the following first and second conditions.

First Conditions

The pulse width Wa ranged between 0.5T and 1.5T, and was most preferably 1.0T. The pulse interval I1 was between 0.3T and 1.4T, and most preferably 0.8T. The pulse width Wb was 0.3T or longer, and most preferably 0.7T. The sum of the pulse interval I1 and the pulse width Wb ranged between 1.3T and 1.7T. The time I2 ranged between 2.25T and 2.75T, and was most preferably 2.5T. The pulse width Wc ranged between 0.3T and 0.8T, and was most preferably 0.5T.

FIG. 7 shows the relation between the pulse interval I1 and the pulse width Wb. In FIG. 7, the circles mean that good printing can be made without ink spatters or ink ejection in wrong directions, and the Xs mean that ink droplets are spattered or ejected onto wrong spots.

Second Conditions

The pulse width Wa was T or nearly N·T where N is 3 or a larger odd number, and most preferably 1.0T, 3.0T or 5.0T. The pulse interval I1 was N·T±0.6T where N is 3 or a larger odd number. Most preferably, the interval I1 was 3.0T, 5.0T and 7.0T. The pulse width Wb ranged between 0.4T and 1.6T, and was most preferably 1.0T. The time I2 ranged between 2.25T and 2.75T, and was most preferably 2.5T. The pulse width Wc ranged between 0.3T and 0.8T or between 1.3T and 1.8T, and was most preferably 0.5T or 1.5T.

FIGS. 8–11 show the relation between the pulse interval I1 and the pulse width Wb. In FIGS. 8–11, the circles mean that good printing can be made without ink spatters or ink ejection in wrong directions, and the Xs mean that ink droplets are spattered or ejected onto wrong spots.

By setting the values Wa, I1, Wb, I2 and Wc as stated above, it was possible to reliably prevent the ink droplets from being spattered or ejected in wrong directions even when the ink temperature was high.

This makes it possible to form a very clear image on recording paper by ejecting two ink droplets for one dot even if the ink temperature is high, which is considered to be frequently high. Of course, if the foregoing values are set as stated above, it is also possible to form a clear image, as was conventionally the case, when the ink temperature is not high.

The pressure developed by the non-ejection pulse cancels the pressure wave vibration. This prevents ink from being ejected accidentally, and makes it possible to transfer to the process in accordance with the next print instruction.

With the voltage of E volts applied from the common electric source 189, the rising and falling points AS, AE, BS, BE, CS and CE of the pulses A–C are adjusted to prevent the ink droplets from being spattered or ejected in wrong directions, and to cancel the pressure wave vibration. This needs only one electric source for outputting the pulses. It is therefore possible to make the structure and the control of the ejector very simple.

The controller might include a device or means for varying the voltage of E volts. For finer adjustment, the varying device might apply voltages as an ejection pulse B and a non-ejection pulse C which are lower than E volts.

In the above embodiment, the actuator walls 603 and the electrodes 619 and 621 correspond to the actuator. The invention is not limited to the foregoing embodiment, but various modifications and/or variations may be made without departing from the spirit of the invention.

The ejector might eject three or more ink droplets in accordance with the print instruction for one dot. In this case as well, it is possible to form a thicker image.

The invention may also be applied to an apparatus for ejecting ink droplets by means of actuators made of material which is not piezoelectric. The invention may further be applied to a line printer, which includes an ink ejector fixed to its body.

What is claimed is:

1. An ink ejector comprising:

an ink jet head for ejecting ink, the head having an ink channel formed therein, which is filled with ink, the head further having an ink nozzle formed therein and communicating with the channel, the head including an actuator provided therein for changing the volume of the channel; and a controller for controlling the actuator to change the channel volume to eject a series of ink droplets from the channel through the nozzle in accordance with the print instruction for one dot;

the controller outputting ejection pulses of voltage for driving the actuator to the actuator in accordance with the print instruction for one dot, the ejection pulses including at least a first pulse and a second pulse which follows the first pulse; the first pulse having a width between 0.5T and 1.5T where T is the one-way propagation time during which a pressure wave is propagated one way in the channel; the interval between the first and second pulses being at least 0.3T; the second pulse having a width which is at least 0.3T; the sum of the interval and the width of the second pulse ranging between 1.3T and 1.7T.

2. The ink ejector defined in claim 1, wherein the width of the first pulse is 1.0T, the interval between the first and second pulses being 0.8T, the width of the second pulse being 0.7T.

3. The ink ejector defined in claim 1, wherein, after outputting the ejection pulses to the actuator, the controller outputs to the actuator a non-ejection pulse of voltage for changing the channel volume to cancel the pressure wave vibration in the channel.

4. The ink ejector defined in claim 3, wherein the time between the trailing edge of the last ejection pulse and the middle point of the non-ejection pulse ranges between 2.25T and 2.75T, the non-ejection pulse having a width between 0.3T and 0.8T.

5. The ink ejector defined in claim 4, wherein the width of the first pulse is 1.0T, the interval between the first and second pulses being 0.8T, the width of the second pulse being 0.7T, the time between a falling point of the last ejection pulse and the middle point of the non-ejection pulse being 2.5T, the width of the non-ejection pulse being 0.5T.

6. The ink ejector defined in claim 5, wherein the ejection pulses consist of the first and second pulses.

7. The ink ejector defined in claim 1, wherein the channel is formed between side walls made of piezoelectric material, and the walls function as the actuator.

8. The ink ejector defined in claim 1, wherein the controller includes a pulse control circuit.

9. The ink ejector defined in claim 8, wherein the pulse control circuit includes a data receiver, a memory, a processing unit and a pulse generator.

10. The ink ejector defined in claim 1, which is an ink jet printer.

11. An ink ejector comprising:

an ink jet head for ejecting ink, the head having an ink channel formed therein, which is filled with ink, the head further having an ink nozzle formed therein and communicating with the channel, the head including an actuator provided therein for changing the volume of the channel; and a controller for controlling the actuator to change the channel volume to eject a series of ink droplets from the channel through the nozzle in accordance with the print instruction for one dot;

the controller outputting ejection pulses of voltage to the actuator in accordance with the print instruction for one dot, the pulses including at least a first pulse and a second pulse which follows the first pulse; the first pulse having a width equaling the one-way propagation time T during which a pressure wave is propagated one way in the channel, or N·T where N is 3 or a larger odd number; the interval between the first and second pulses being N·T±0.6T; the second pulse having a width between 0.4T and 1.6T.

12. The ink ejector defined in claim 11, wherein the ejection pulses consist of the first and second pulses, the width of the first pulse being one of 1.0T, 3.0T and 5.0T, the interval between the first and second pulses being one of 3.0T, 5.0T and 7.0T, the width of the second pulse being 1.0T.

13. The ink ejector defined in claim 11, wherein, after outputting the ejection pulses to the actuator, the controller outputs to the actuator a non-ejection pulse of voltage for changing the channel volume to cancel the pressure wave vibration in the channel.

14. The ink ejector defined in claim 13, wherein the time between a falling point of the last ejection pulse and the middle point of the non-ejection pulse ranges between 2.25T and 2.75T, the non-ejection pulse having a width between 0.3T and 0.8T.

15. The ink ejector defined in claim 13, wherein the time between a trailing edge of the last ejection pulse and the middle point of the non-ejection pulse ranges between 2.25T and 2.75T, the non-ejection pulse having a width between 1.3T and 1.8T.

16. The ink ejector defined in claim 13, wherein the ejection pulses are the first and second pulses, the width of the first pulse being one of 1.0T, 3.0T and 5.0T, the interval between the first and second pulses being one of 3.0T, 5.0T and 7.0T, the width of the second pulse being 1.0T, the time between a falling point of the last ejection pulse and the middle point of the non-ejection pulse being 2.5T, the non-ejection pulse having a width of either of 0.5T and 1.5T.

17. The ink ejector defined in claim 11, wherein the channel is formed between side walls made of piezoelectric material, and the walls functions as the actuator.

18. The ink ejector defined in claim 11, wherein the controller includes a pulse control circuit.

19. The ink ejector defined in claim 18, wherein the pulse control circuit includes a data receiver, a memory, a processing unit and a pulse generator.

20. The ink ejector defined in claim 11, which is an ink jet printer.

* * * * *